United States Patent [19]

Eichele et al.

[11] 4,363,607

[45] Dec. 14, 1982

[54] RADIAL PISTON PUMP

[75] Inventors: Erich Eichele, Schwab Gmund; Winfried de Maight, Mutlangen, both of Fed. Rep. of Germany

[73] Assignee: Zahnradfabrik Friedrichshafen, AG, Friedrichshafen, Fed. Rep. of Germany

[21] Appl. No.: 111,916

[22] Filed: Jan. 14, 1980

[30] Foreign Application Priority Data

Jan. 13, 1979 [DE] Fed. Rep. of Germany ..... 2901240

[51] Int. Cl.[3] ..... F04B 1/18; F04B 27/04

[52] U.S. Cl. ..... 417/273; 417/313

[58] Field of Search ..... 417/273, 312; 181/197, 181/241, 237

[56] References Cited

U.S. PATENT DOCUMENTS

| | | | |
|---|---|---|---|
| 1,854,830 | 4/1932 | Flanders | 181/197 |
| 2,184,891 | 12/1939 | Bourne | 417/312 |
| 3,125,034 | 3/1964 | Lucian | 417/273 |
| 3,145,800 | 8/1964 | Marx | 181/241 |
| 3,191,544 | 6/1965 | Szekely | 417/273 |
| 3,885,893 | 5/1975 | Glock | 417/273 |

FOREIGN PATENT DOCUMENTS

| | | | |
|---|---|---|---|
| 2802307 | 7/1978 | Fed. Rep. of Germany | 181/237 |
| 2270466 | 5/1975 | France | 417/312 |

*Primary Examiner*—William L. Freeh

*Attorney, Agent, or Firm*—Zalkind & Shuster

[57] ABSTRACT

A surge chamber hydraulically connected between the outlet of a radial piston pump and the internal chambers of the piston plungers, cooperates with a second fluid storing surge chamber in the pump housing through connecting passages to dampen vibrations produced by pump flow fluctuations to reduce non-uniform flow and the noise level during pump operation under a wide range of pressures and speeds.

2 Claims, 3 Drawing Figures

RADIAL PISTON PUMP

BACKGROUND OF THE INVENTION

This invention relates to radial piston pumps and more particularly to an improved radial piston pump construction for reducing vibrations accompanying pump operation.

Radial piston pumps of the type having spring loaded plungers displaced by an eccentric to effect unidirectional flow of fluid through openings in the plunger walls from chambers internally of the plungers to surge chambers externally of the plungers, are already known as disclosed, for example, in German Pat. Nos. OS 2,243,138 and AS 2,061,960. Such pumps advantageously operate to limit flow through intake restrictors and also reduce pump torque, that otherwise increases with pump speed, to conserve output generated energy. However, such pumps have the disadvantage of operating with a high degree of non-uniform rate of fluid supply to the fluid consuming devices or systems being serviced by the pump. Correspondingly high pressure pulsations result from such operation producing a disturbing effect. If, for example, such a pump is used for supply of fluid to an auxiliary power steering system, the pressure pulsations are felt by the driver of a vehicle on the hand steering wheel. Further, the compressional vibrations produced by such pressure pulsations create noise which often exceeds tolerable levels. If other fluid pressure consumers such as level regulators and braking systems are supplied with pressure fluid, a pressure fluid reservoir is then utilized as disclosed for example, in U.S. Pat. No. 4,012,993. The pressure reservoir in such case serves to store pressure fluid during periods of lower consumption to insure full operation of all fluid systems at all times. The pressure reservoir inserted between the pump and the fluid pressure systems also acts as a vibration dampener so as to reduce the transfer of such vibrations. Such pressure reservoir may, however, affect only compressional vibrations within a limited operating pressure range and at low frequencies. For compressional vibrations within a wide pressure range of 0 to 130 BAR and between pump speeds of 600 to 6,000 rpm applicable to a suction regulated radial piston pump for auxiliary power steering systems, the foregoing vibration reducing measures will be very costly and yet inadequate.

It is therefore an important object of the present invention to reduce non-uniform flow caused by high flow rate pulsations in the fluid supply stream and resulting noise from a radial piston pump by means of a low cost constructional modification so that such pump may be used without vibration suppressors for auxiliary power steering systems, for example.

SUMMARY OF THE INVENTION

In accordance with the present invention, a radial piston pump of the type having a plurality of reciprocating plungers inducing unidirectional flow of fluid from chambers internally of the plungers to an outlet connected surge chamber within which the fluid is collected, is modified so as to enclose a second surge chamber in fluid communication with the first mentioned surge chamber. The surge chambers may be formed as annular cavities within axial spaced end covers associated with the pump housing. The end covers are held assembled with an intermediate housing body through which the connecting passages between the surge chambers extend. Adjustable flow restrictors may be placed within such connecting passages.

As a result of the foregoing pump construction, the fluid collected within the two chambers act as an elastic energy storing means so that the mass of fluid located in the connecting passages between the surge chambers is alternately displaced against the resistance of the fluid stored in the two surge chambers. As a result of the foregoing arrangement, compressional vibrations and pressure background noises are considerably reduced. Only a minimal increase in production costs are involved to modify a radial piston pump in accordance with the present invention without altering its volumetric capacity.

An important advantage of the pump construction of the present invention resides in the fact that it embodies the vibration damping means directly within the pump housing itself so that no other dampening measures are required during pump installation.

BRIEF DESCRIPTION OF DRAWING FIGURES

Preferred embodiments of the invention are hereinafter described in greater detail with reference to the accompanying drawings in which.

DETAILED DESCRIPTION OF PREFERRED EMBODIMENTS

Figure 2:
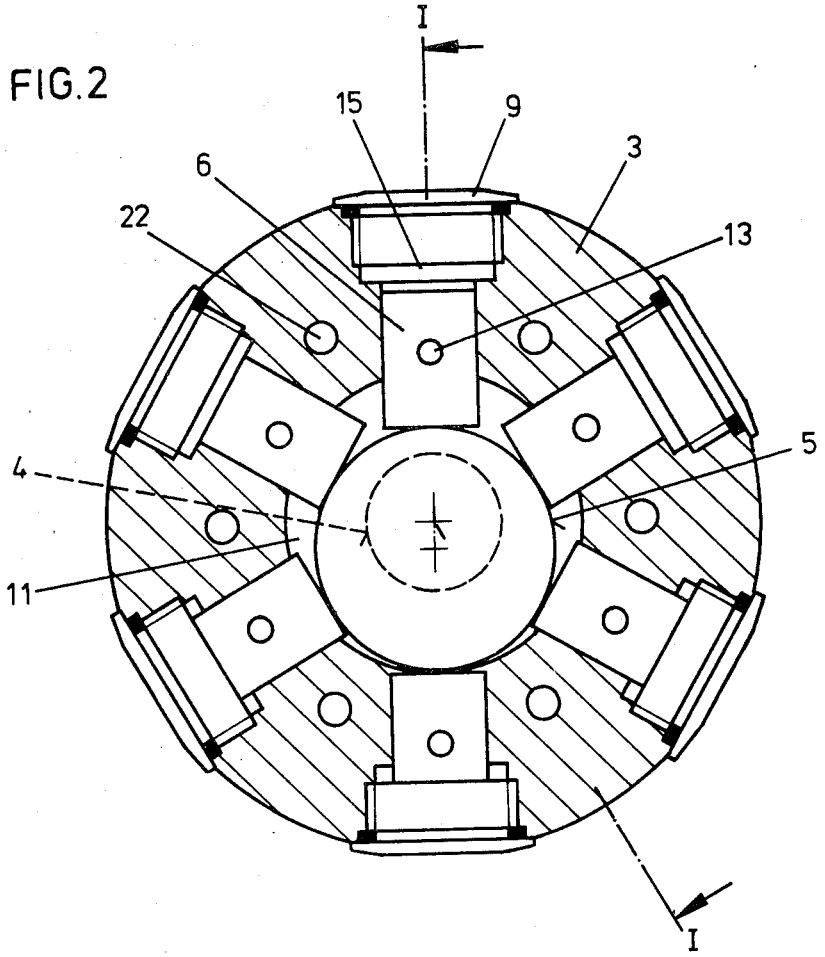
FIG. 2 is a transverse section view taken substantially through a plane indicated by section line II—II in FIG. 1.
Figure 3:
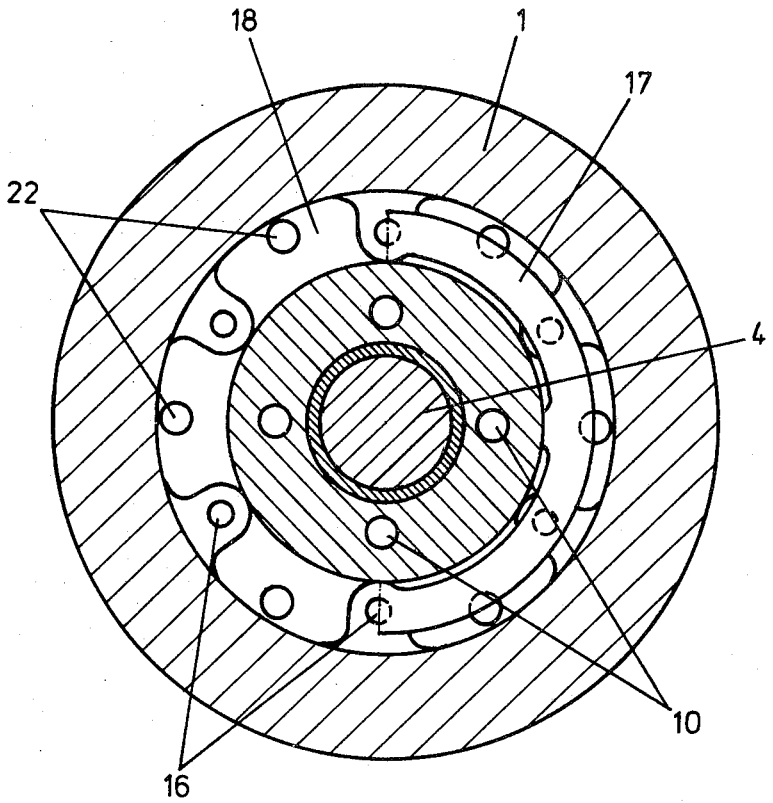
FIG. 3 is a transverse section view taken substantially through a plane indicated by section line III—III in FIG. 1.

Referring now to the drawings in detail, a radial piston pump is shown enclosed by a housing having two axially spaced bearing covers 1 and 2 assembled by threaded fasteners with an intermediate housing body 3. A power shaft 4 supported by the bearing covers 1 and 2, carries an eccentric actuator or cam 5 for imparting radial reciprocation to a plurality of piston plungers enclosed within the housing body 3. Six plungers are shown by way of example in FIG. 2, equiangularly spaced with respect to the longitudinal axis of the housing. The plungers 6 are guided for movement in the housing and are held in contact with the peripheral surface of the cam 5 by compression springs 7 supported on screw caps 9 threadedly mounted in the housing body 3. A fluid reservoir tank (not shown) is in fluid communication with an annular suction chamber 11 through an intake connection 8 and passages 10. The suction chamber 11 surrounds the radially inner ends of the plungers in contact with the cam 5. The plungers 6 have inlet apertures 12 and 13 formed in the walls thereof through which pressure fluid is drawn and displaced in a known manner through the internal chambers 14 in the plungers and cylinder chambers 15 into compression passages 16. The compression passages 16 are connected by a circular shaped, flat spring valve 17 to a surge chamber 18 within which fluid is collected. The surge chamber is formed by an annular cavity in the cover 1. The flat spring valve 17 is held in contact with a seating surface 20 on the housing body 3 in a known manner during operation of the pump by the operating pressure in the surge chamber 18 and is lifted off the seating surface adjacent those compression passages 16 conducting fluid under operating pressure to the surge chamber 18. Thus, the valve 17 will prevent return flow of fluid from the surge chamber 18. The surge chamber 18 is connected to outlet 21 in fluid communication with a pressurized fluid consuming device or system serviced by the pump.

According to the illustrated embodiment of the invention, surge chamber 18 disposed in the bearing cover 1 is connected by conduit means in the form of passages 22 to a second surge chamber 23 formed by an annular cavity in the bearing cover 2. As a result of the two relatively small and interconnected surge chambers 18 and 23, the compressional vibrations produced within the full pump operational range of pressures and speeds may be dampened to a larger degree than would be possible, for example, with a pressure dampening reservoir connected series with the pump or by a substantially enlarged surge chamber 18 alone.

Figure 1:
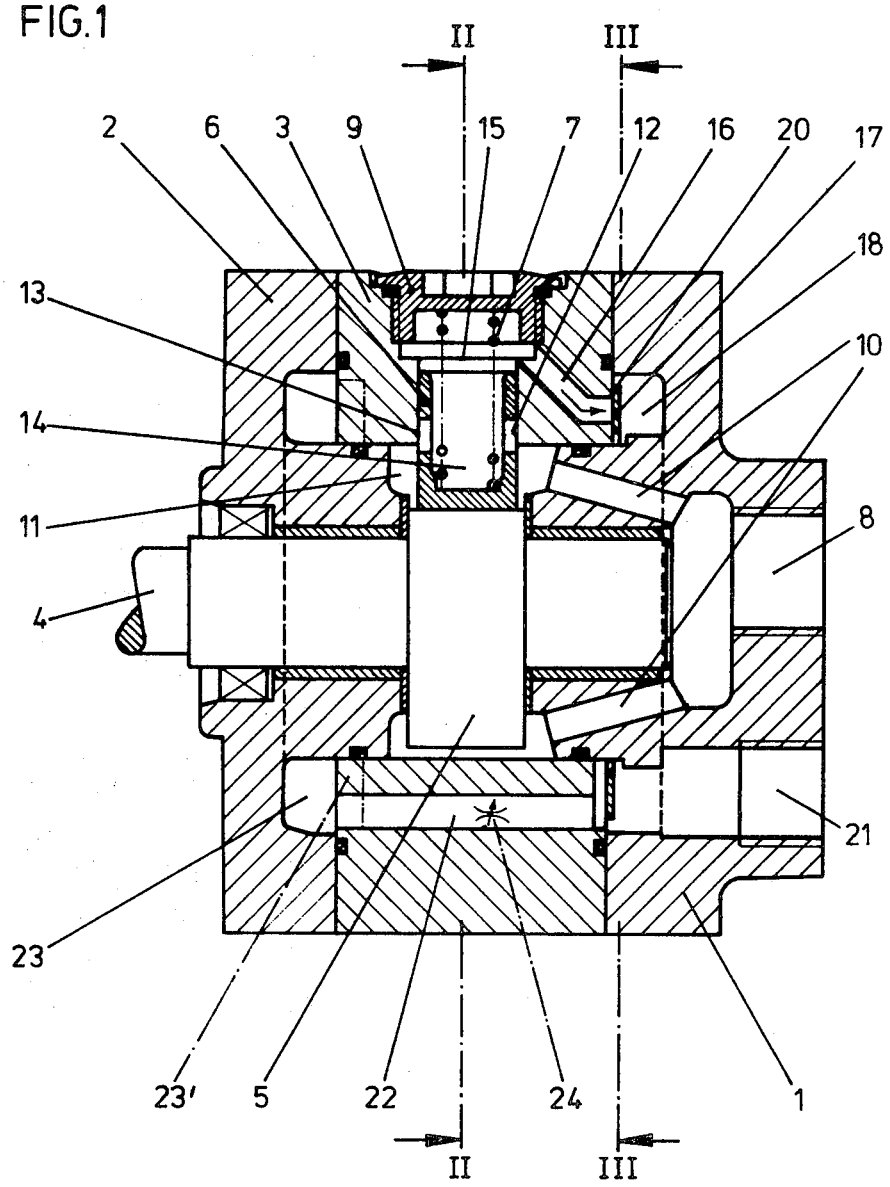
FIG. 1 is a side section view through a radial piston pump constructed in accordance with the present invention.

For purposes of synchronization, the connecting passages 22 may be provided with adjustable flow restrictors 24 to control bidirectional flow between the surge chambers. Also, as an alternative embodiment, the second surge chamber 23 may be replaced by a surge chamber 23' formed within the housing body 3 itself, as shown by dot-dash line in FIG. 1.

What is claimed is:

1. In a radial piston pump construction having a housing (1-2-3) mounting a plurality of spring-loaded plungers (6) operated by an eccentric (5) to effect unidirectional flow of fluid from chambers (14) internally of the plungers to a surge chamber (18) connected to an outlet (21), the improvement residing in a second surge chamber (23) enclosed in the housing, and conduit means (22) interconnecting said surge chambers, said conduit means comprising a plurality of connecting passages formed in said housing, said housing including a body (3) within which the plungers are mounted and a pair of end covers (1 and 2) secured to the body in a axially spaced relation to each other, said first mentioned surge chamber (18) being formed by an annular cavity in one of the end covers (1), the second surge chamber (23) being formed by an annular cavity in the other of the end covers (2).

2. In a radial piston pump construction having a housing (1-2-3) mounting a plurality of spring-loaded plungers (6) operated by an eccentric (5) to effect unidirectional flow of fluid from chambers (14) internally of the plungers to a surge chamber (18) connected to an outlet (21), the improvement residing in a second surge chamber (23) enclosed in the housing, and conduit means (22) interconnecting said surge chambers, said conduit means comprising a plurality of connecting passages formed in said housing, said housing including a body (3) within which the plungers are mounted and a pair of end covers (1 and 2) secured to the body in axially spaced relation to each other, said first mentioned surge chamber (18) being formed by an annular cavity in one of the end covers (1), the second surge chamber (23') being formed by an annular cavity in the body.

* * * * *